US008615906B2

(12) United States Patent
Matthias et al.

(10) Patent No.: US 8,615,906 B2
(45) Date of Patent: Dec. 31, 2013

(54) DRILLING BUCKET

(75) Inventors: Eric Matthias, Spencer, IA (US); Michael Reinert, Ruthven, IA (US)

(73) Assignee: Pengo Corporation, Delhi, IA (US)

( * ) Notice: Subject to any disclaimer, the term of this patent is extended or adjusted under 35 U.S.C. 154(b) by 71 days.

(21) Appl. No.: 13/448,105

(22) Filed: Apr. 16, 2012

(65) Prior Publication Data

US 2013/0269220 A1 Oct. 17, 2013

(51) Int. Cl.
*E02F 3/24* (2006.01)
*E02F 3/407* (2006.01)

(52) U.S. Cl.
USPC ..... 37/189; 37/445; 175/316

(58) Field of Classification Search
USPC ..... 37/189, 341, 444, 445, 182, 466, 901; 175/238, 316
See application file for complete search history.

(56) References Cited

U.S. PATENT DOCUMENTS 904,680 A * 11/1908 Burrows ..... 294/68.24
1,926,325 A * 9/1933 Bertran ..... 175/316
2,873,950 A * 2/1959 Kandle ..... 175/94
2,997,797 A * 8/1961 Frankum, III ..... 37/341
3,185,226 A 5/1965 Robbins
4,335,793 A * 6/1982 Roblin ..... 175/65
4,616,720 A 10/1986 Kitanaka
4,627,180 A 12/1986 Learnahan
4,971,163 A 11/1990 Ohashi
5,234,062 A 8/1993 Inoue
5,797,202 A * 8/1998 Akesaka ..... 37/189
6,533,048 B2 * 3/2003 Groce et al. ..... 175/316
6,655,476 B2 * 12/2003 Groce et al. ..... 175/316
7,938,198 B2 5/2011 He

* cited by examiner

*Primary Examiner* — Matthew D Troutman
(74) *Attorney, Agent, or Firm* — Ryan N. Carter

(57) ABSTRACT

A drilling bucket adapted to combine with a prime mover vehicle such as an excavator. The drilling bucket includes a floor pivotally combined with the bucket. The floor has an open position wherein collected spoils are emptied from the bucket and a closed position for retaining spoils in the bucket during operation. A release assembly is adapted to securely hold the floor in its closed position until it is actuated to release it to its open position. Some embodiments of the drilling bucket comprise two separate internal cavities. The first cavity is adapted to receive the spoils as the bucket is rotated beneath the ground by the prime mover vehicle. The second cavity is adapted to house portions of the release assembly. The second cavity may serve as a vent which allows air to pass the bucket as the bucket is being raised or lowered in a hole.

11 Claims, 7 Drawing Sheets

DRILLING BUCKET

BACKGROUND

The present invention relates generally to a drilling bucket for excavating dirt, sand, rock or the like (collectively "spoils") from beneath the ground surface.

Drilling buckets are well known devices used for excavating. A drilling bucket is similar in function to an earth auger in that it is rotated by a prime mover vehicle such as an excavator to produce a hole in the ground. In contrast to an earth auger, however, a drilling bucket does not convey dirt to the top of the hole while it is being rotated. Instead, a drilling bucket captures spoils in the bucket's cavity which is raised to the surface and emptied after it becomes full.

Drilling buckets typically have a hinged floor that can be opened automatically or manually to empty the captured dirt. Floors that open automatically typically requires the operator of the prime mover vehicle to actuate a crash plate which forcibly contacts the drilling bucket to mechanically release the floor latching mechanism. One problem with automatic release mechanisms is that crash plates are not uniform in size so that some crash plates are not properly aligned to actuate the mechanical automatic release linkage on some drilling buckets.

As is known in the art, most drilling buckets have two separate floor sections. The first floor section is adapted to rotate relative to the second floor section. In use, the drilling bucket is rotated by the prime mover vehicle in a first direction causing the first floor section to rotate behind the second floor creating one or more openings in the floor which are adapted to receive spoils as rotation by the prime mover is continued. When the bucket is full, the prime mover rotates the bucket in the opposite direction causing the opening(s) in the floor to close by rotating the first floor section to back to its original closed position.

SUMMARY

The present invention comprises a drilling bucket adapted to combine with a prime mover vehicle such as an excavator. The drilling bucket includes a floor pivotally combined with the bucket. The floor has an open position wherein collected spoils are emptied from the bucket and a closed position for retaining spoils in the bucket during operation. A release assembly is adapted to securely hold the floor in its closed position until it is actuated to release the floor to its open position. The release assembly may be actuated manually or automatically. The automatic release assembly includes a plunger combined with a release mechanism via a cam assembly. The cam assembly allows the plunger to be positioned near the center of the bucket to receive downward force from the prime mover's crash plate while the release mechanism is positioned near the outer periphery of the bucket. The manual release assembly allows actuation of the release mechanism by manually releasing the release mechanism, such as by pulling a lever.

Some embodiments of the drilling bucket comprise two separate internal cavities. The first cavity is adapted to receive the spoils as the bucket is rotated beneath the ground by the prime mover vehicle. The second cavity is adapted to house portions of the release assembly. Separating the release assembly from the earthen spoils helps to protect the release assembly from damage. Further, in some embodiments, the second cavity serves as a vent which allows air to pass the bucket as the bucket is being raised or lowered in a hole.

DETAILED DESCRIPTION

Figure 1:
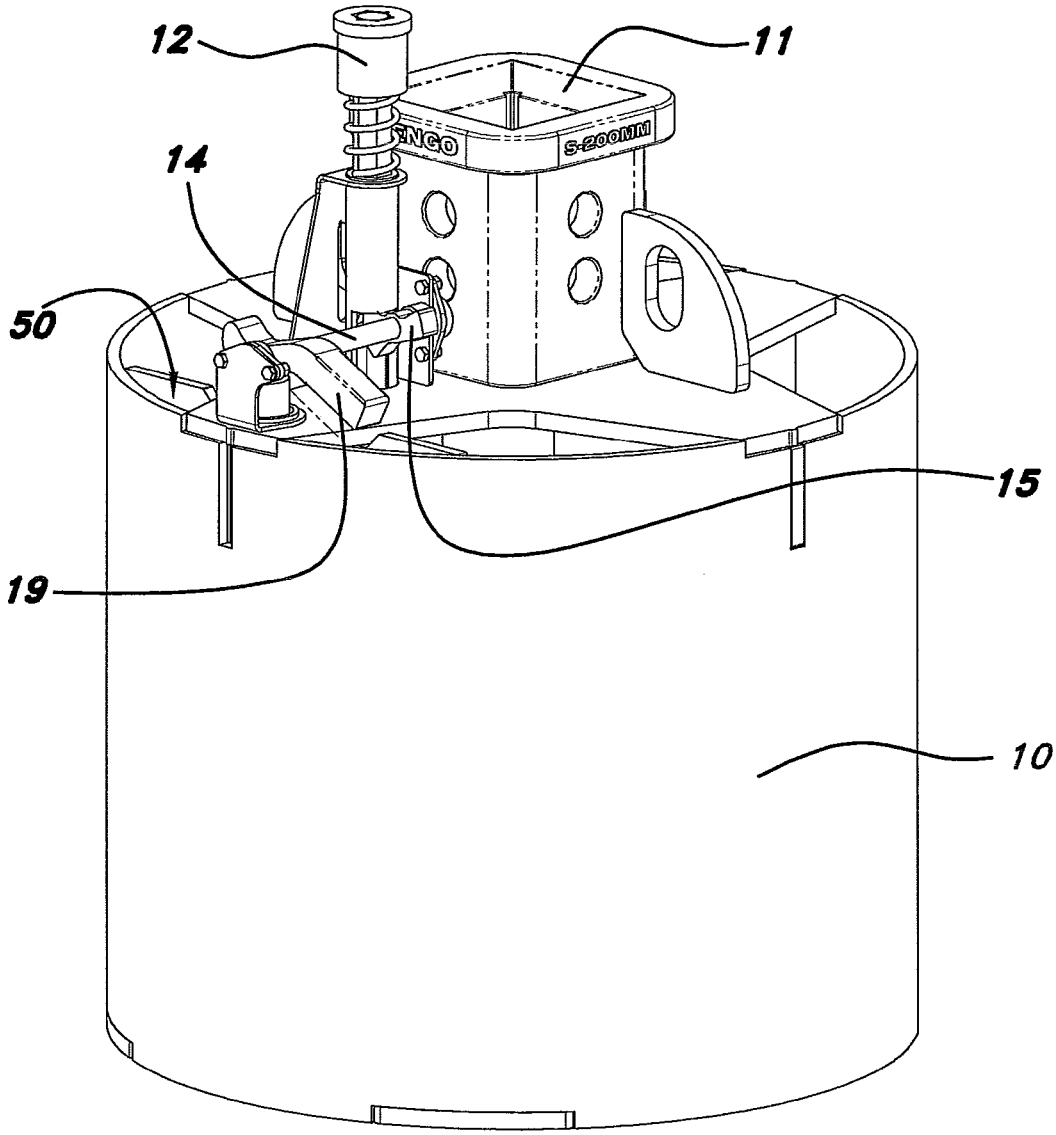
FIG. 1 is a perspective view of the bucket.
Figure 5:
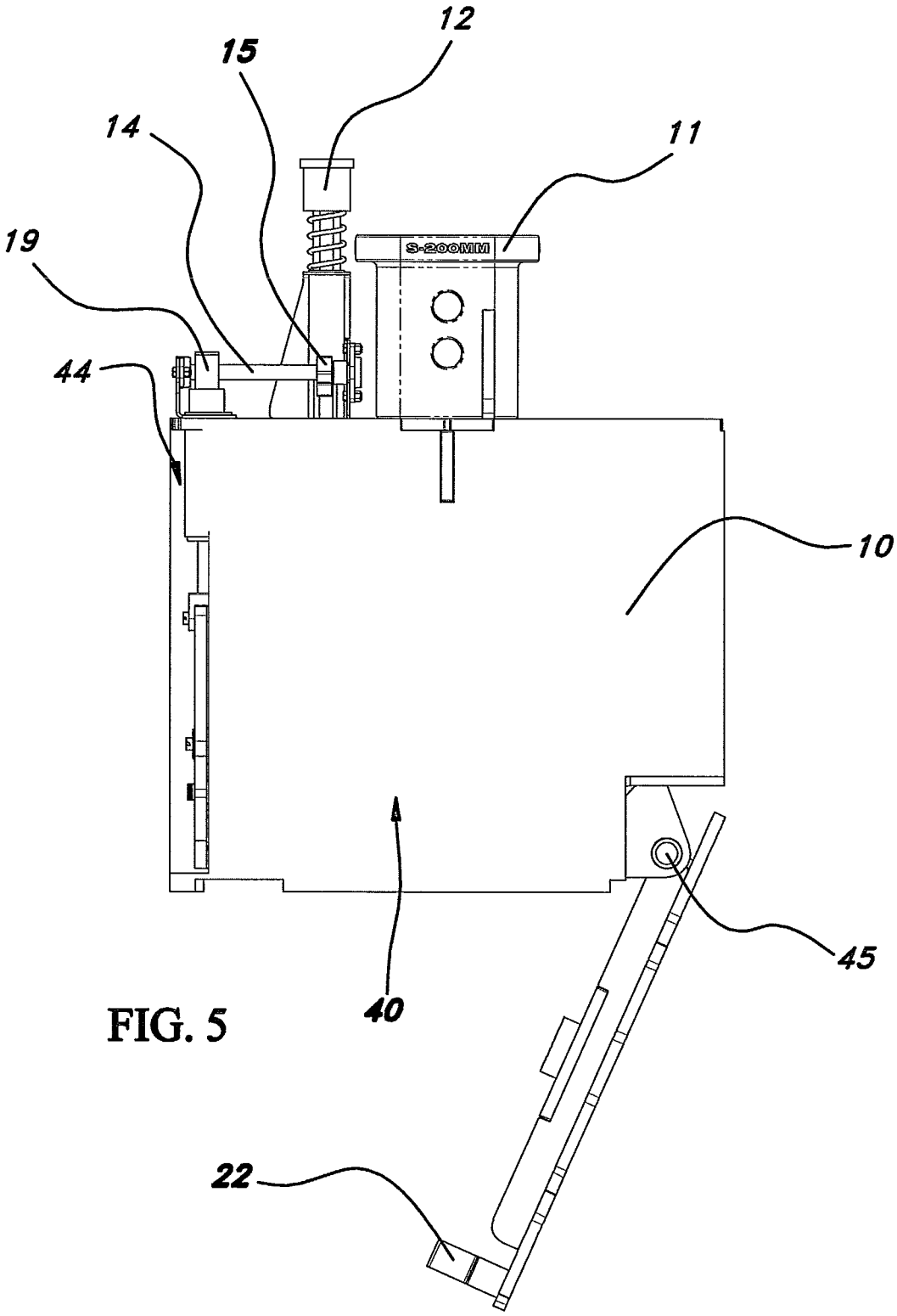
FIG. 5 is a side view showing the bottom of the buck in its open position to release the collected spoils.

The present invention comprises a drilling bucket 10 adapted to combine with a prime mover vehicle 29 such as an excavator via a coupler 11. The drilling bucket 10 comprises a floor pivotally combined with the bucket 10 via hinge 45. FIG. 1 shows the floor in its closed position and FIG. 5 shows the floor in its open position. During drilling operation the floor is secured in its closed position by a release assembly allowing the bucket 10 to gather spoils inside its cavity 40. After the spoils have been collected and the bucket 10 raised to the surface, then the release assembly can be actuated to open the floor and release the spoils from the cavity 40.

Figure 2:
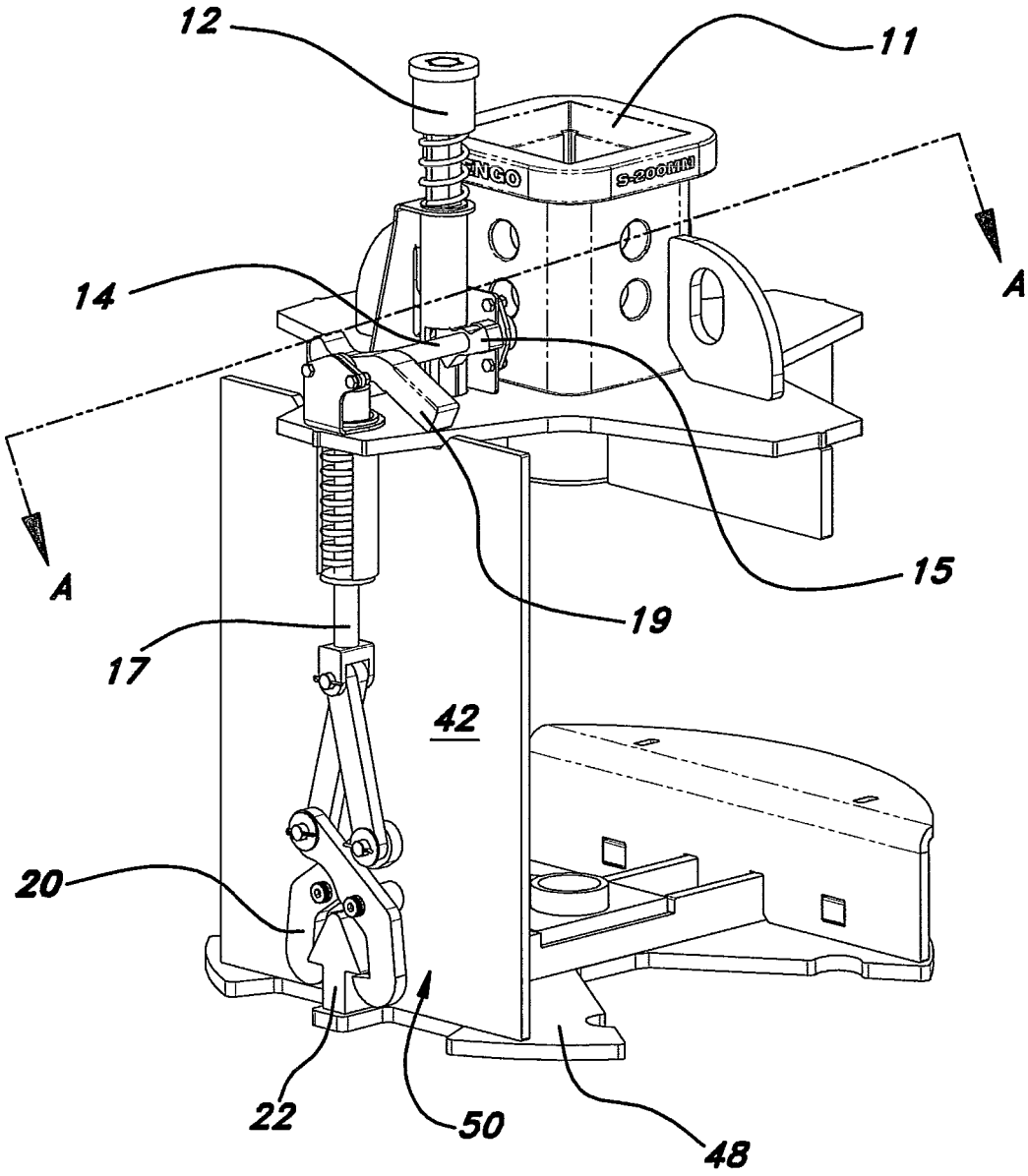
FIG. 2 is a perspective view of the internal components of the bucket with the bucket walls removed.
Figure 3:
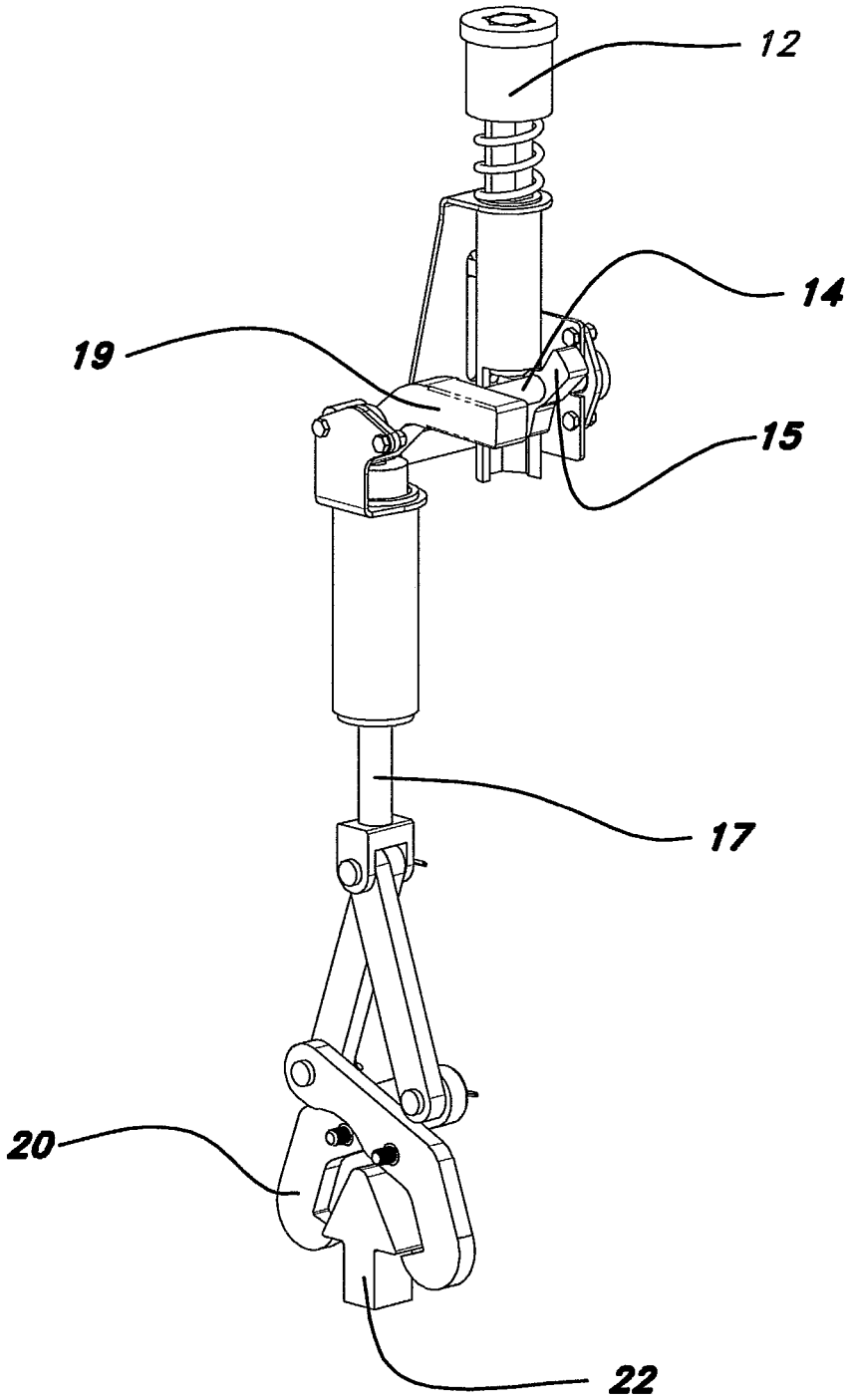
FIG. 3 is a side view of the release assembly.
Figure 8:
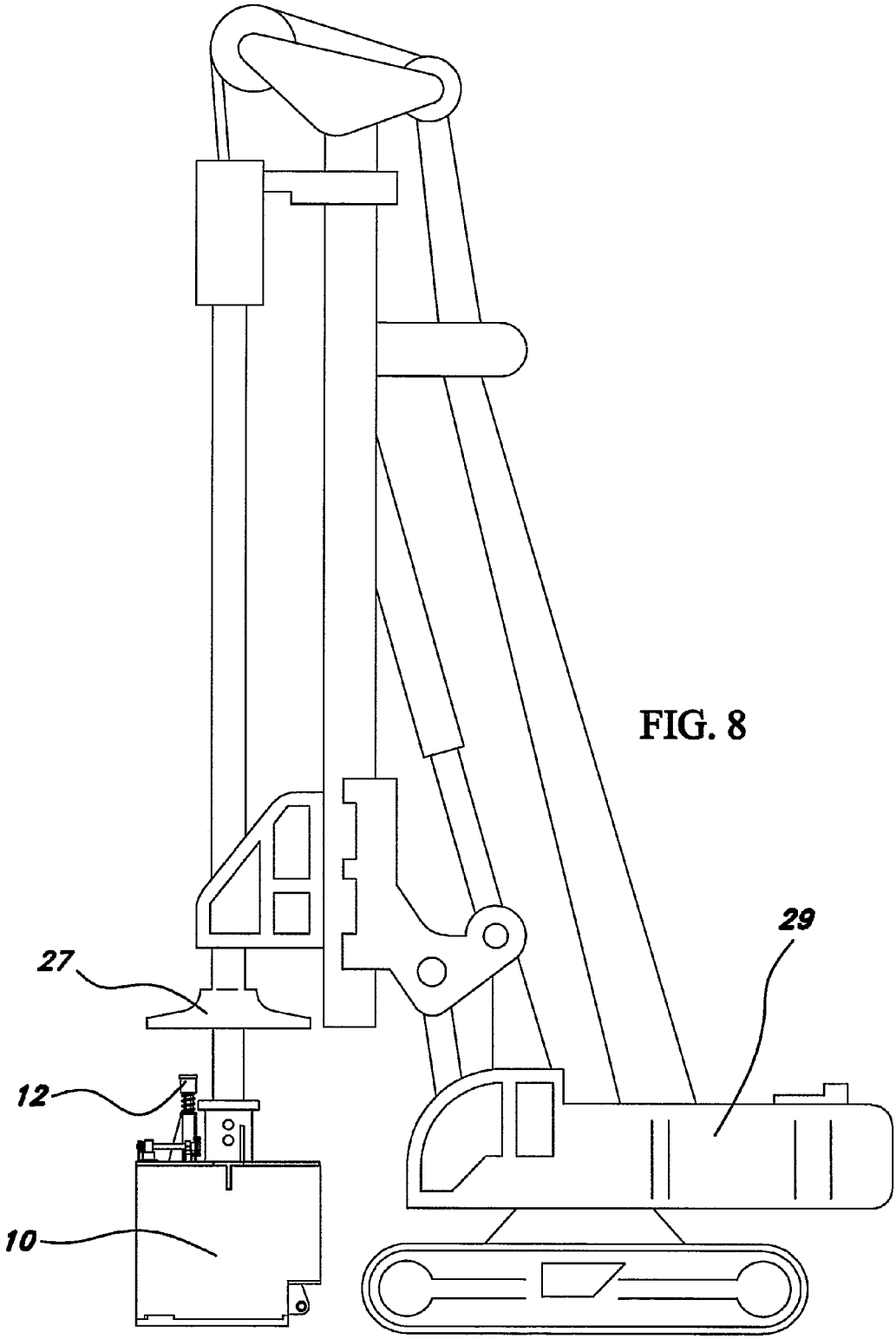
FIG. 8 shows the bucket combined with a prime mover vehicle.

FIGS. 2 and 3 show an embodiment of the release assembly adapted to selectively release the floor. The release assembly generally comprises a plunger 12, a cam shaft 14, a connecting member 17, and a latching mechanism 20. The plunger 12 has a first position and a second position and is biased in its first position by a compression spring or other suitable means. The plunger 12 is adapted to be actuated (i.e. moved to its second position) by the downward force of a crash plate 27. FIG. 8 shows a prime mover vehicle 29 having a crash plate 27 positioned above the bucket 10. The plunger 12 is preferably mounted near the center of the bucket 10 so that it can be actuated by crash plates 27 of various sizes (i.e. smaller diameters and larger diameters). Upon actuation, the plunger 12 pushes down on a member 15 combined with the cam shaft 14 which causes the cam shaft 14 to rotate. The cam shaft 14 extends laterally from the plunger 12 toward the outer portion of the bucket 10 where it is combined with lever 19. As it is rotated by the plunger 12, the cam shaft 14 rotates lever 19 which engages connecting member 17 causing the latching mechanism 20 to move to its open position. In other words, the linear motion of the plunger 12 is translated to rotational motion of the cam shaft 14 then back to linear motion of the connecting member 17. In the embodiment shown, the latching mechanism 20 comprises scissor arms having clasps which engage a retainer member 22, which is combined with the floor. In some embodiments the retainer member 22 is shaped like an arrowhead. The connecting member 17 has first position wherein the latching mechanism 20 is closed and a second position wherein the latching mechanism is open, the connecting member is biased in its first position by a compression spring or other suitable means. Removal of pressure from the plunger 12 causes the compression springs to return the plunger 12 and connecting member 17 to their first positions thereby closing the latching mechanism. When the floor is returned to its closed position it is securely held by the release assembly until the assembly is actuated again.

Figure 4:
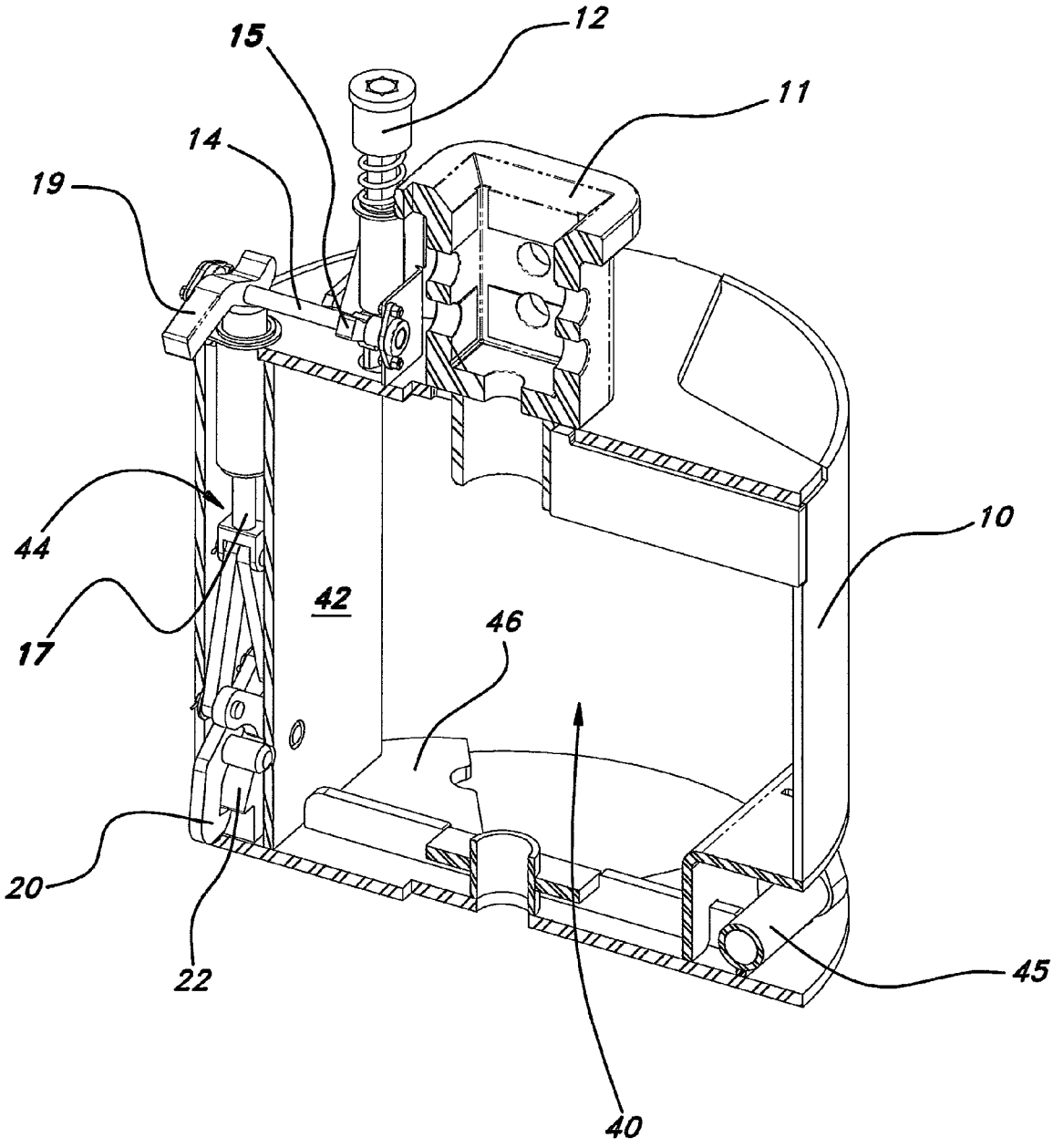
FIG. 4 is a section view taken along line A-A of FIG. 2.

The release assembly may be actuated manually or automatically. Automatic actuation of the release assembly is caused by actuation of the crash plate 27 which pushes down on the plunger 12 to rotate the cam shaft 14 as discussed in the previous paragraph. Crash plates 27 are generally known in the art and are commonly attached to prime mover vehicles 29 used in drilling bucket operations. Manual actuation of the release assembly is caused when the user manually turns the cam shaft 14. As shown in FIGS. 3 and 4, some embodiments include a lever 19 combined with the cam shaft 14 for this purpose. The location of the lever 19 near the outer periphery of the bucket 10 allows users to more easily access the lever 19 during manual actuation of the release assembly. In the embodiments shown in FIGS. 6 and 7, the lever 19 is adapted to selectively combine with a tube or bar 16 to increase the user's mechanical advantage thereby making it easier for the user to rotate the cam shaft 14 manually with the lever 19.

Figure 6:
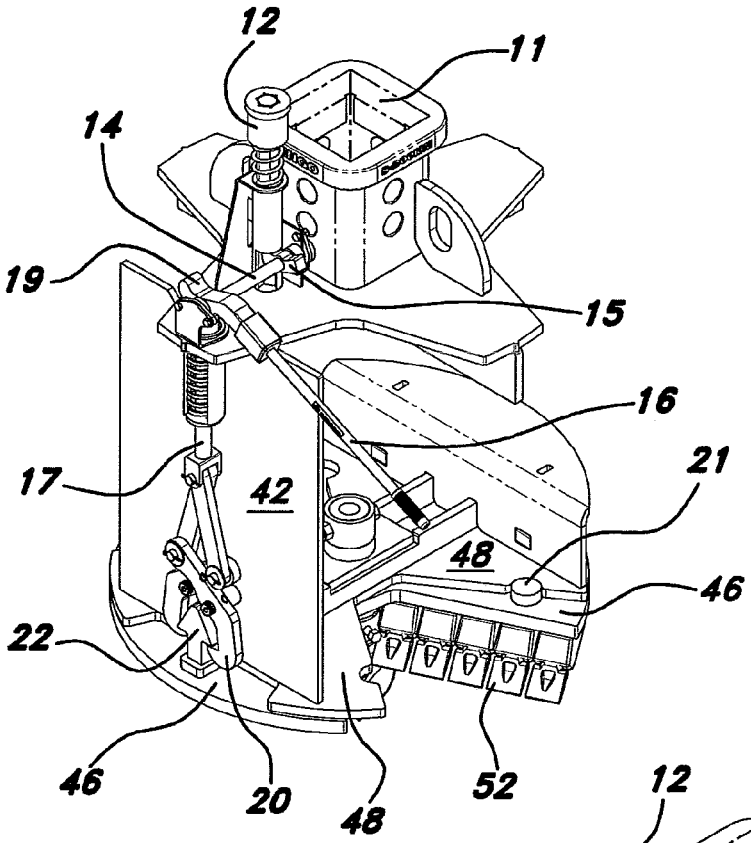
FIG. 6 is a perspective view of the internal components of the bucket showing the floor in its first configuration.
Figure 7:
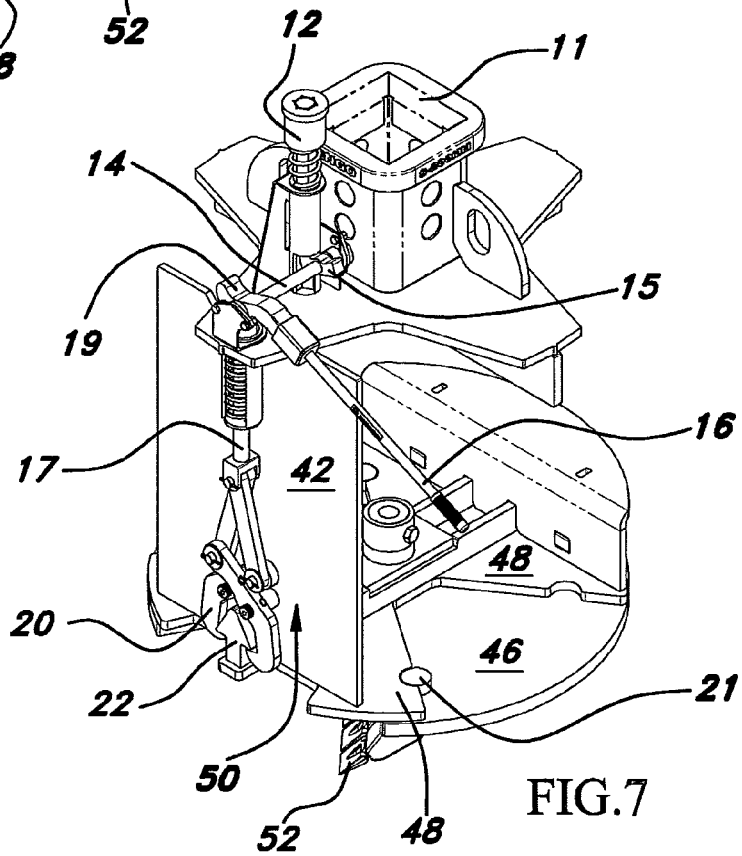
FIG. 7 is a perspective view of the internal components of the bucket showing the floor in its second configuration.

In addition to the floor opening for the purpose of emptying the spoils from the cavity 40 as discussed above, the floor also includes a means for selectively opening to allow spoils to enter the cavity 40. As shown in FIGS. 6 and 7, the floor includes a first portion 48 and a second portion 46. The first portion 48 is fixed in place and the second portion 46 rotates relative to the first portion 48 and is adapted to rotate behind the first potion 48 thereby creating one or more openings in the floor under the cavity 40. A stopping member 21 prevents the second portion 46 from rotating too far relative to the first portion 48. During drilling operations, the rotation of the bucket 10 causes the second portion 46 of the floor to rotate behind the first portion 48 thereby allowing spoils to enter the cavity 40 through the opening(s) in the floor. This shall be referred to as the floor first configuration. FIG. 6 shows the floor in its first configuration. Angled blades 52 force spoils into the cavity 40 as the bucket 10 is rotated. After the bucket's cavity 40 is full, rotation of the bucket 10 in the opposite direction returns the second portion 46 of the floor to its original position (FIG. 7) to prevent spoils from draining from the cavity 40 as the bucket 10 is raised to the surface. This shall be referred to as the floor second configuration.

As shown in FIG. 4, some embodiments of the drilling bucket 10 comprise two separate internal cavities 40, 44. The first cavity 40 is adapted to receive the spoils as the bucket 10 is rotated beneath the ground by the prime mover vehicle 29. The second cavity 44 is adapted to house portions of the release assembly. The second cavity 44 is separated from the first cavity 40 by a wall 42 which prevents spoils from the first cavity 40 from entering the second cavity 44. The outer wall of the second cavity 44 is preferably the outer wall of the bucket 10. Separating the release assembly from the earthen spoils helps to protect the release assembly from damage. As discussed above, the release assembly includes a cam shaft 14 which allows the plunger 12 to be located near the center of the bucket 10 while other portions of the release assembly are located near the outer periphery of the bucket 10. The second cavity 44 is located near the outer periphery of the bucket 10 to allow the first cavity 40 to be as large as possible.

In some embodiments, the second cavity 44 serves as a vent which allows air to pass the bucket 10 as the bucket 10 is being raised or lowered in a hole. As shown in FIGS. 6 & 7, the first potion 48 of the floor has one or more openings 50 allowing air to pass through the second cavity 44. As shown in FIG. 6, the second portion 46 blocks the openings 50 when the floor is in its first configuration to prevent spoils from entering the second cavity 44 during drilling operations. As shown in FIG. 7, the second portion 46 of the floor has openings that align with openings 50 when the floor is in its second configuration thereby allowing air to pass through the second cavity 44 as the bucket 10 is being raised or lowered in a hole.

Having thus described the invention in connection with the preferred embodiments thereof, it will be evident to those skilled in the art that various revisions can be made to the preferred embodiments described herein with out departing from the spirit and scope of the invention. It is my intention, however, that all such revisions and modifications that are evident to those skilled in the art will be included with in the scope of the following claims.

What is claimed is as follows:

1. A drilling bucket having a center portion and an outer portion, said drilling bucket comprising:

a main body having a first cavity and a second cavity, wherein the first cavity is adapted to receive spoils;

a floor pivotally combined with the main body portion, said floor having an open position and a closed position; and a release assembly adapted to selectively allow the floor to move between its open position and its closed position, wherein a portion of the release assembly is located in the second cavity to help prevent it from being damaged by spoils during drilling operation;

wherein the release assembly comprises a plunger, a cam shaft, a connecting member, and a latching mechanism;

wherein the plunger is located near the center of the bucket, the connecting member is located near the outer portion of the bucket, and the cam shaft operatively combines the plunger and the connecting member to translate linear motion of the plunger to rotational motion of the cam shaft to linear motion of the connecting member.

2. The drilling bucket of claim 1 wherein the release assembly comprises a retainer member combined with the floor and a latching mechanism adapted to selectively release the retainer member.

3. The drilling bucket of claim 2 wherein the latching mechanism is a pair of scissor arms having clasps which selectively release the retainer member.

4. The drilling bucket of claim 1 wherein the latching mechanism is located in the second cavity.

5. A drilling bucket for drilling a hole, said drilling bucket comprising:

a main body having a first cavity and a second cavity, wherein the first cavity is adapted to receive spoils;

a floor pivotally combined with the main body portion, said floor having an open position wherein collected spoils are emptied from the bucket and a closed position for retaining spoils in the bucket during operation, said floor further having a first portion and a second portion, wherein the second portion rotates relative to the first portion to create a floor first configuration and a floor second configuration;

wherein an opening is formed in the first cavity but not in the second cavity when the floor is in its first configuration to receive spoils in the first cavity during drilling operations, and wherein an opening is formed in the second cavity but not in the first cavity when the floor is in its second configuration to allow air to pass through the second cavity as the bucket is raised and lowered in the hole.

6. The drilling bucket of claim 5 further comprising a release assembly adapted to selectively allow the floor to move between its open position and its closed position, wherein part of the release assembly is located in the second cavity to prevent it from being damaged during drilling operation.

7. The drilling bucket of claim 5 wherein the bucket has a center portion and an outer portion, and the second cavity is located near the outer portion.

8. A drilling bucket having a center portion and an outer portion, said drilling bucket comprising:

a main body having a cavity therein adapted to receive spoils;

a floor pivotally combined with the main body, said floor having an open position wherein collected spoils are emptied from the bucket and a closed position for retaining spoils in the bucket during operation;

a release assembly adapted to selectively allow the floor to move between its open position and its closed position;

wherein the release assembly further comprises a plunger, a cam shaft, a connecting member, and a latching mechanism having an open position and a closed position;

wherein the plunger is located near the center portion of the bucket and is adapted to rotate the cam shaft, which extends laterally from the plunger toward the outer portion of the bucket to engage the connecting member which is adapted to move the latching mechanism between its open and closed position.

9. The drilling bucket of claim 8 further comprising a lever combined with the cam shaft.

10. The drilling bucket of claim 9 further comprising a bar adapted to selectively combine with the lever to enable a user to manually actuate the release assembly.

11. The drilling bucket of claim 8 wherein the plunger is adapted to be actuated by a crash plate that is combined with a prime mover vehicle.

* * * * *